US010627151B2

(12) United States Patent
Downs et al.

(10) Patent No.: US 10,627,151 B2
(45) Date of Patent: Apr. 21, 2020

(54) HINGE COUPLING ASSEMBLY

(71) Applicant: Colder Products Company, St. Paul, MN (US)

(72) Inventors: Dennis Daniel Downs, Andover, MN (US); Jaime Richard Erickson, New Prague, MN (US)

(73) Assignee: Colder Products Company, St. Paul, MN (US)

( * ) Notice: Subject to any disclaimer, the term of this patent is extended or adjusted under 35 U.S.C. 154(b) by 380 days.

(21) Appl. No.: 15/422,066

(22) Filed: Feb. 1, 2017

(65) Prior Publication Data

US 2017/0205136 A1 Jul. 20, 2017

Related U.S. Application Data

(63) Continuation of application No. 12/882,702, filed on Sep. 15, 2010, now Pat. No. 9,593,518.
(Continued)

(51) Int. Cl.
*E05D 11/00* (2006.01)
*F25D 23/02* (2006.01)
*B67D 1/08* (2006.01)

(52) U.S. Cl.
CPC ..... *F25D 23/028* (2013.01); *B67D 1/0857* (2013.01); *E05D 11/00* (2013.01);
(Continued)

(58) Field of Classification Search
CPC ..... F25C 2400/14; F25D 2323/024; E05Y 2900/31; E05Y 2800/10; E05D 11/0081
See application file for complete search history.

(56) References Cited

U.S. PATENT DOCUMENTS 3,429,140 A 2/1969 White
3,872,541 A 3/1975 Peterson
(Continued)

FOREIGN PATENT DOCUMENTS

DE 1147852 B * 4/1963 ..... E05D 11/0081
EP 1167890 A2 * 1/2002 ..... E05D 11/0081
(Continued)

OTHER PUBLICATIONS

International Search Report and Written Opinion issued in PCT/US2010/048945 dated Dec. 7, 2010, 12 pages.
(Continued)

*Primary Examiner* — David Bochna
(74) *Attorney, Agent, or Firm* — Fish & Richardson P.C.

(57) ABSTRACT

A hinge coupling assembly includes a first coupling incorporated within a first hinge section coupled to a door, including a first end and an opposite second end connecting a first coupling passage formed within the first coupling, and a second coupling incorporated within a second hinge section separate from the first hinge section and coupled to a door frame, the second coupling including a first end and an opposite second end connecting a second coupling passage formed within the second coupling. Connection and disconnection of the first coupling to the second coupling to create a single sealed continuous passage formed by the first coupling passage and second coupling passage is simultaneous upon installation and removal of the door to the door frame. The sealed continuous passage is maintained upon radial and axial displacement of the first coupling with respect to the second coupling upon opening and closing of the door.

8 Claims, 13 Drawing Sheets

Related U.S. Application Data

(60) Provisional application No. 61/242,627, filed on Sep. 15, 2009.

(52) U.S. Cl.
CPC ..... *E05D 11/0081* (2013.01); *E05Y 2800/10* (2013.01); *E05Y 2900/31* (2013.01); *F25C 2400/14* (2013.01); *F25D 2323/024* (2013.01); *Y10T 16/554* (2015.01)

(56) References Cited

U.S. PATENT DOCUMENTS

| | | | | |
|---|---|---|---|---|
| 3,964,207 | A * | 6/1976 | Peterson | E05D 7/081 49/388 |
| 3,988,859 | A | 11/1976 | Peterson | |
| 4,070,728 | A | 1/1978 | Herman | |
| 4,543,800 | A | 10/1985 | Mawby | |
| 5,033,777 | A | 7/1991 | Blenkush | |
| 5,263,509 | A | 11/1993 | Cherry | |
| 5,787,724 | A | 8/1998 | Pohl et al. | |
| 5,941,619 | A * | 8/1999 | Stieben | F25D 23/028 16/223 |
| 7,547,047 | B2 | 6/2009 | deCler et al. | |
| 9,593,518 | B2 | 3/2017 | Downs et al. | |
| 2007/0204647 | A1* | 9/2007 | Puthiyaveetil | F25D 23/126 62/389 |
| 2007/0251261 | A1 | 11/2007 | Son et al. | |
| 2008/0018212 | A1 | 1/2008 | Spearing et al. | |
| 2010/0147007 | A1 | 6/2010 | Froelicher et al. | |
| 2013/0047656 | A1 | 2/2013 | Kang et al. | |
| 2017/0292750 | A1* | 10/2017 | Yang | F25C 1/24 |

FOREIGN PATENT DOCUMENTS

| | | | | |
|---|---|---|---|---|
| WO | WO-2007087699 A1 * | 8/2007 | | E05D 11/0081 |
| WO | WO 2008/011458 | 1/2008 | | |
| WO | WO 2007/087699 | 8/2017 | | |

OTHER PUBLICATIONS

International Preliminary Report on Patentability in Application No. PCT/US2010/048945, dated Mar. 3, 2012, 7 pages.

* cited by examiner

HINGE COUPLING ASSEMBLY

RELATED APPLICATIONS

This application is a continuation of U.S. application Ser. No. 12/882,702, filed Sep. 15, 2017, now U.S. Pat. No. 9,593,518, which claims the benefit of U.S. Patent Application Ser. No. 61/242,627 filed on Sep. 15, 2009. The entireties of the related applications are hereby incorporated by reference.

BACKGROUND

Many modern refrigerators include doors with modules that provide access to water and/or ice. For example, a user can hold a cup within the module mounted in the door to obtain cool water or ice. To accomplish this, the door is coupled through the refrigerator cabinet to a source of water. Typically, tubing is routed through the refrigerator, through the door, and to the module to provide the water.

SUMMARY

According to one aspect, an example hinge coupling assembly includes: a first coupling incorporated within a first hinge section coupled to a door, the first coupling including a first end and an opposite second end connecting a first coupling passage formed within the first coupling; a second coupling incorporated within a second hinge section separate from the first hinge section and coupled to a door frame, the second coupling including a first end and an opposite second end connecting a second coupling passage formed within the second coupling; wherein connection and disconnection of the first coupling to the second coupling to create a single sealed continuous passage formed by the first coupling passage and the second coupling passage results upon installation and removal of the door to the door frame; and wherein the sealed continuous passage is maintained upon radial and axial displacement of the first coupling with respect to the second coupling upon opening and closing of the door.

According to another aspect, an example refrigerator includes: at least one door; at least one distributer coupled to the door; and a hinge coupling assembly including: a first coupling incorporated within a first hinge section coupled to the door, the first coupling including a first end and an opposite second end connecting a first coupling passage formed within the first coupling; a second coupling incorporated within a second hinge section separate from the first hinge section and coupled to a door frame, the second coupling including a first end and an opposite second end connecting a second coupling passage formed within the second coupling; wherein connection and disconnection of the first coupling to the second coupling to create a single sealed continuous passage formed by the first coupling passage and second coupling passage results upon installation and removal of the door to the door frame; and wherein the sealed continuous passage is maintained upon radial and axial displacement of the first coupling with respect to the second coupling upon opening and closing of the door.

According to yet another aspect, an example method for connecting a water conduit to a distributor in a door of a refrigerator includes: incorporating a first coupling within a first hinge section coupled to the door; incorporating a second coupling within a second hinge section separate from the first hinge section and coupled to a door frame; and attaching the door to the refrigerator to form a fluid passage through the first and second couplings, the fluid passage being maintained upon radial and axial displacement of the first coupling with respect to the second coupling upon opening and closing of the door.

DESCRIPTION OF THE DRAWINGS

Aspects of the disclosure may be more completely understood in consideration of the following detailed description of various embodiments of the disclosure in connection with the accompanying drawings.

DETAILED DESCRIPTION

The example embodiments described in the following disclosure are provided by way of illustration only and should not be construed as limiting. Various modifications and changes may be made to the example embodiments described below without departing from the true spirit and scope of the disclosure.

The present disclosure relates to a coupling assembly integrated within a door hinge. The coupling assembly is configured such that disconnection and connection is simultaneous upon installation and removal of a door to the door hinge. The coupling assembly is additionally configured to include portions that rotate and displace with respect to each other upon opening and closing of the door, while maintaining the seal and flow path of the coupling assembly. Although the present disclosure is not so limited, an appreciation of the various aspects of the disclosure will be gained through a discussion of the examples provided below.

Figure 1:
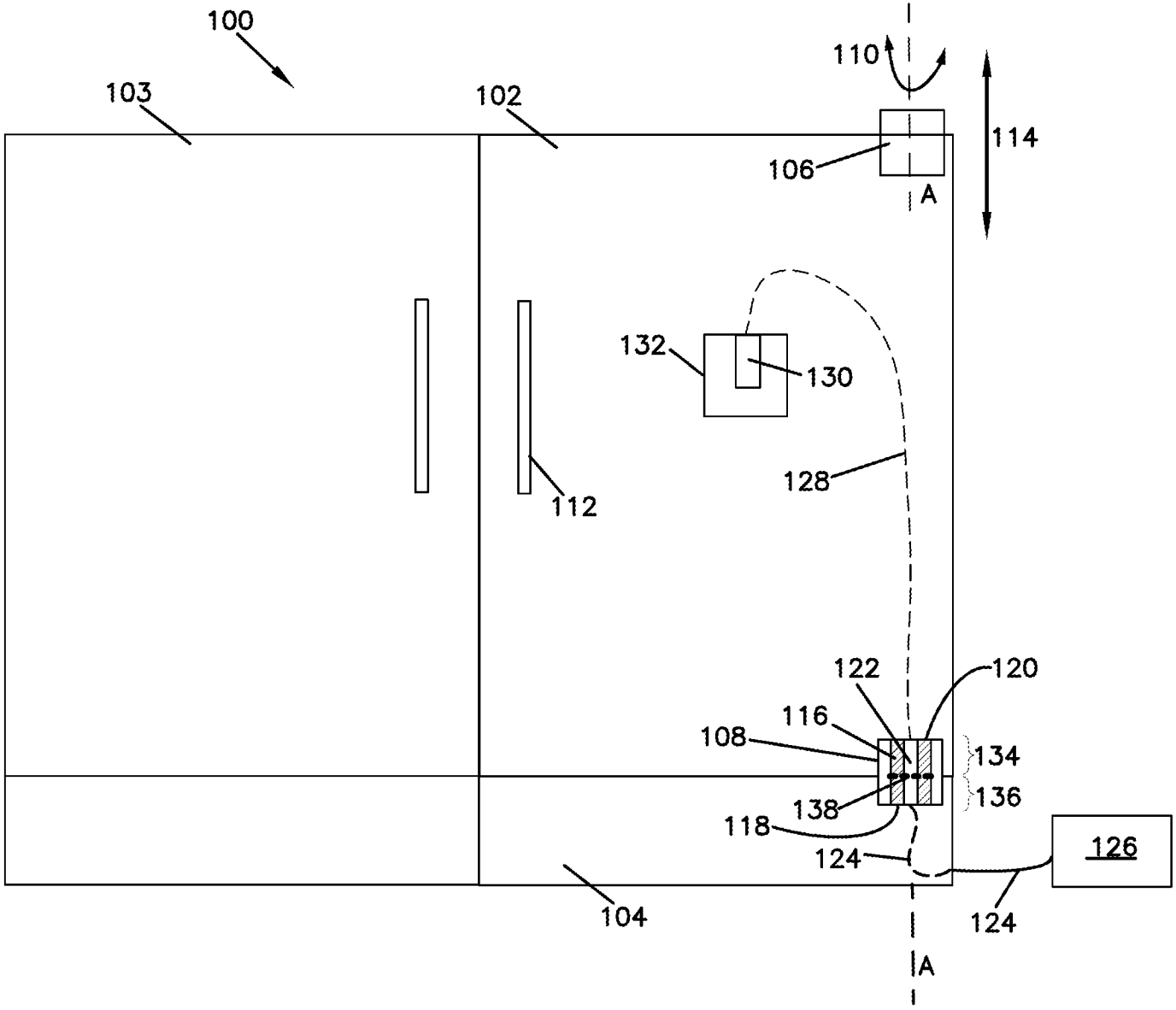
FIG. 1 is a front view of a refrigerator including an example hinge coupling assembly according to the principles of the present disclosure.

Referring now to FIG. 1, an example refrigerator 100 incorporating aspects of the present disclosure is shown. The refrigerator 100 includes doors 102, 103 and a base 104. In the example shown, the refrigerator 100 is a traditional side-by-side door refrigerator, although other types of refrigerators, such as French door or top/bottom freezer refrigerators, can also be used.

The door 102 is coupled to the refrigerator 100 by an upper hinge assembly 106 and a lower hinge assembly 108. Other embodiments of the refrigerator 100 are possible.

The upper and lower hinge assembly 106, 108 are each configured to allow the door 102 to pivot in directions 110 on an axis A. Accordingly, a handle 112 mounted on the door 102 may be grasped to move the door 102 between an open position and a closed position such that internal compartments of the refrigerator 100 are accessible. The upper and lower hinge assembly 106, 108 are each additionally configured to allow the door 102 to be moved in directions 114 parallel to the axis A. In this manner, the door 102 may removed and installed to the refrigerator 100 as desired.

A coupling assembly 116 is incorporated within the lower hinge assembly 108. The coupling assembly 116 includes a first end 118 and an opposite second end 120 connected by an internal channel 122 formed within the coupling assembly 116. The first end 118 is connected to a first conduit 124, which in turn is connected to a source 126. In the example shown, the source 126 is external to the refrigerator 100 and a portion of the first conduit 124 is internal to the base 104, designated in FIG. 1 as a dashed line. Other embodiments are possible as well.

The second end 120 of the coupling assembly 116 is connected to a second conduit 128, which in turn is connected to an outlet 130 of a distributer 132 incorporated within the door 102. The second conduit 128 is located internal to the door 102, designated in FIG. 1 as a dashed line. In example embodiments, the outlet 130 and at least some portions of the distributer 132 are accessible to a user without opening the door 102. Other embodiments are possible as well.

A series connection formed by the first conduit 124, the coupling assembly 116, and the second conduit 128 allows for a material to be transferred from the source 126 to the outlet 130. In example embodiments, the first and second conduit 124, 128 are tubing such that a fluid (e.g., liquids, gases, etc.) is transferred from the source 126 to the outlet 130 via the internal channel 122 of the coupling assembly 116. For example, the outlet 130 can be used by the user to obtain cool water. Other embodiments are possible. For example, the first and second conduit 124, 128 may be cabling that form a connection within the internal channel 122 of the coupling assembly 116 such that electricity (e.g., modulated signal, power, etc.) is transferred between the source 126 and the outlet 130. Still other embodiments are possible as well.

The lower hinge assembly 108 (and the coupling assembly 116 incorporated within) is segmented into at least a first section 134 and a second section 136. The first and second section 134, 136 are coupled together at an interface 138. The first and second sections 134, 136 are aligned with respect to each other along axis A such that the portion of the internal channel 122 within each of the first and second section 134, 136 are aligned to form a continuous flow path.

In general, the first section 134 is affixed to the door 102. In one embodiment, the first section 134 is mounted to the door 102. In another embodiment, the first section 134 is at least partially incorporated internal to the door 102. In contrast, the second section 136 is affixed to the refrigerator 100. In one embodiment, the second section 136 is mounted to the base 104. In another embodiment, the second section 136 is mounted to a frame (not shown) of the refrigerator 100.

By virtue of the disclosed configuration of the lower hinge assembly 108, disconnection and connection of the coupling assembly 116 incorporated within is simultaneous upon installation and removal of the door 102 to the refrigerator 100.

For example, when the door 102 is removed from the refrigerator 100, the first section 134 is decoupled from the second section 136 such that the internal channel 122 no longer forms a continuous flow path. In the example embodiment, the door 102 is moved in directions 114 such that the first section 134 is separated from the second section 136 by virtue of the first section 134 being affixed to the door 102 and the second section 136 being affixed to the refrigerator 100, as described above. In this manner, the coupling assembly 116 is disconnected upon removal of the door 102 from the refrigerator 100.

When the door 102 is installed to the refrigerator 100, the first section 134 is coupled to the second section 136 such that the internal channel 122 forms a continuous flow path. In the example embodiment, the first section 134 is aligned with the second section 136 along axis A by handling the door 102 in directions 114. Subsequently, the first section 134 is brought into contact and coupled with the second section 136 at the interface 138. The weight of the door 102 maintains the first and section sections 134, 136 in the coupled state. In this manner, the coupling assembly 116 is connected upon installation of the door 102 to the refrigerator 100.

Figure 2:
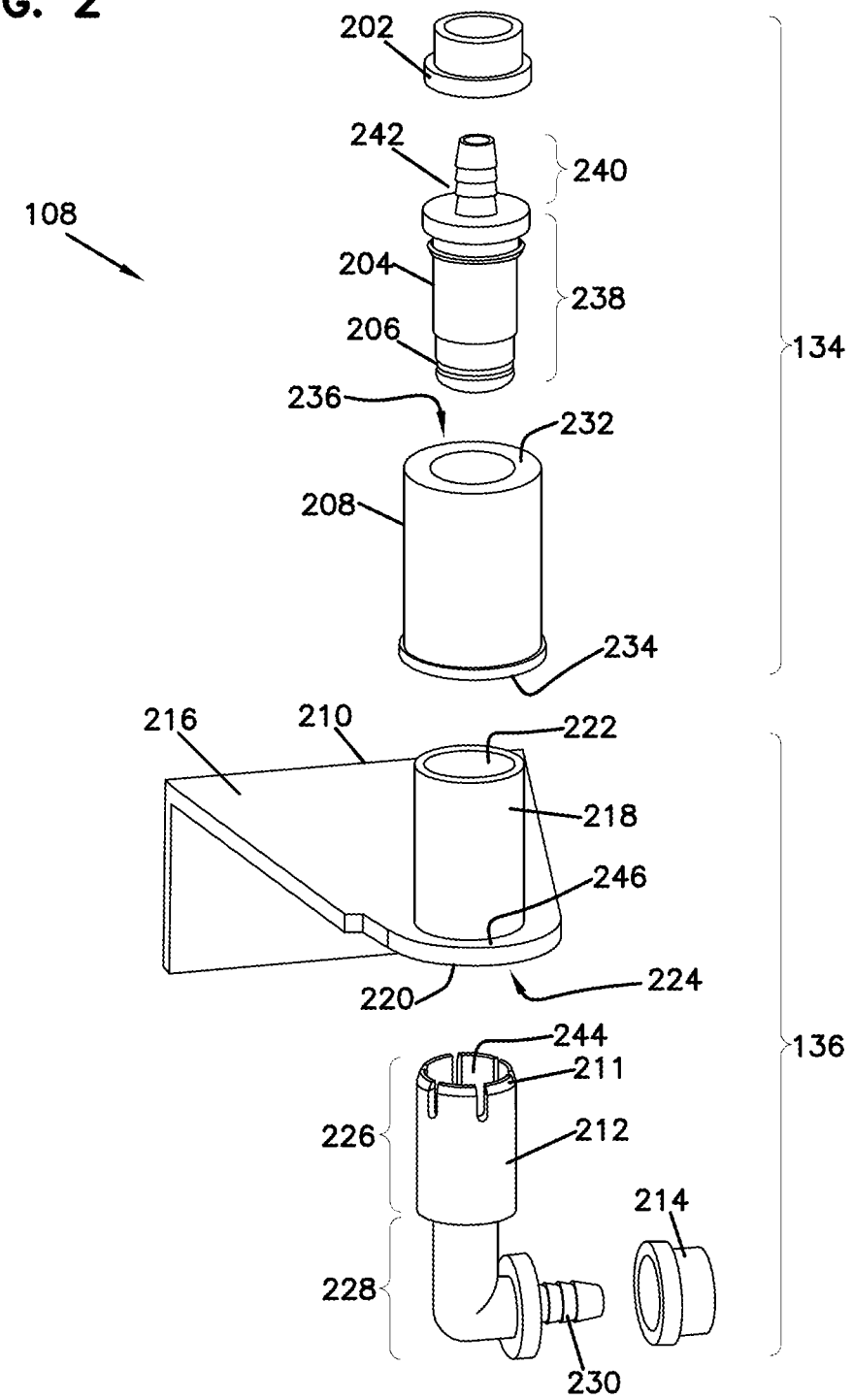
FIG. 2 is an exploded perspective view of an example hinge coupling assembly.
Figure 3:
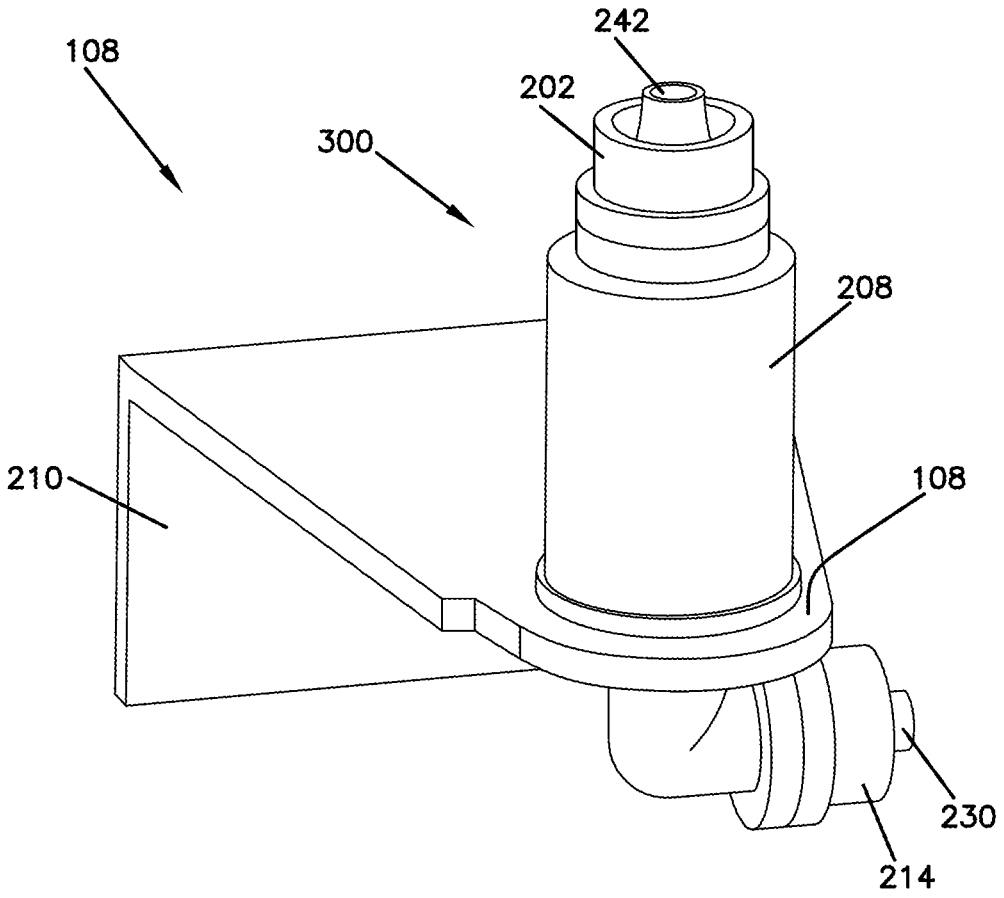
FIG. 3 is a perspective view of the hinge coupling assembly of FIG. 2 in a coupled state.

Referring now to FIGS. 2 and 3, the lower hinge assembly 108 described above with respect to FIG. 1 is shown. FIG. 2 is an exploded perspective view of the example lower hinge assembly 108. FIG. 3 is a front perspective view of the example lower hinge assembly 108 in a coupled state 300.

The example lower hinge assembly 108 includes a first retainer 202, a male coupling 204, a sealing ring 206, a bushing 208, a hinge pin 210, a female coupling 212, and a second retainer 214.

The first retainer 202, male coupling 204, sealing ring 206, and bushing 208, when assembled, correspond to the first section 134 of the lower hinge assembly 108. The hinge pin 210, female coupling 212, and second retainer 214, when assembled, correspond to the second section 136 of the lower hinge assembly 108. Other embodiments of the lower hinge assembly 108 are possible.

The hinge pin 210 includes a securing flange 216 and a post 218. The securing flange 216 is used to affix the hinge pin 210 to the refrigerator 100. The post 218 includes a first post end 220 and an opposite second post end 222 connecting a post inner passage 224 formed within the post 218. The post inner passage 224 is configured to receive and secure a first female coupling section 226 of the female coupling 212.

In one embodiment, the first female coupling section 226 is secured to the post inner passage 224 via a radial pressure fitting. The radial pressure fitting is established by forming an outer diameter of the first female coupling section 226 greater than a diameter of the post inner passage 224. In the example shown, snaps 211 are provided on the first female coupling section 226 to engage a complementary structure in the post inner passage 224 to create a snap fit. Other embodiments are possible. For example, instead of a snap fit, a press fit or threaded configuration can be used.

When the first female coupling section 226 is positioned within the post inner passage 224, a second female coupling section 228 extends from the first post end 220. In this position, the second retainer 214 is coupled to a female coupling termination 230 of the second female coupling section 228. The second retainer 214 is configured to receive and secure tubing (e.g., first conduit 124) to the female coupling termination 230.

The bushing 208 includes a first bushing end 232 and an opposite second bushing end 234 connecting a bushing inner passage 236 formed within the bushing 208. The bushing inner passage 236 is configured to receive and secure a first male coupling section 238.

In one embodiment, the first male coupling section 238 is secured to the bushing inner passage 236 via a press fit. The weight of the door maintains the first male coupling section 238 coupled to the bushing inner passage 236. Other embodiments are possible as well.

When the first male coupling section 238 is positioned within the bushing inner passage 236, a second male coupling section 240 extends from the first bushing end 232. In this position, the first retainer 202 is coupled to a male coupling termination 242 of the second male coupling section 240. The first retainer 202 is configured to receive and secure tubing (e.g., second conduit 128) to the male coupling termination 242.

As noted above, the first and second sections 134, 136, as assembled, are configured to be coupled and decoupled from each other. In the coupled position (see FIG. 3), the post 218 of the hinge pin 210 is positioned within the bushing inner passage 236 of the bushing 208. In this position, the male coupling 204 is connected to the female coupling 212 to create a continuous fluid flow path therebetween, described further below. In the decoupled position, the post 218 of the hinge pin 210 is disengaged from the bushing inner passage 236 of the bushing 208, thereby disconnecting the male coupling 204 from the female coupling 212 and breaking the continuous fluid flow path therebetween.

In connecting the male coupling 204 to the female coupling 212, the first male coupling section 238 is inserted within the first female coupling section 226 such that the sealing ring 206 radially engages a female coupling inner surface 244, as described further below. The first male coupling section 238 is inserted until the second bushing end 234 engages a hinge second surface 246 of the hinge pin 210. The hinge second surface 246 partially supports weight of the door 102 and allows the door 102 to be positioned between open and closed positions.

Figure 4:
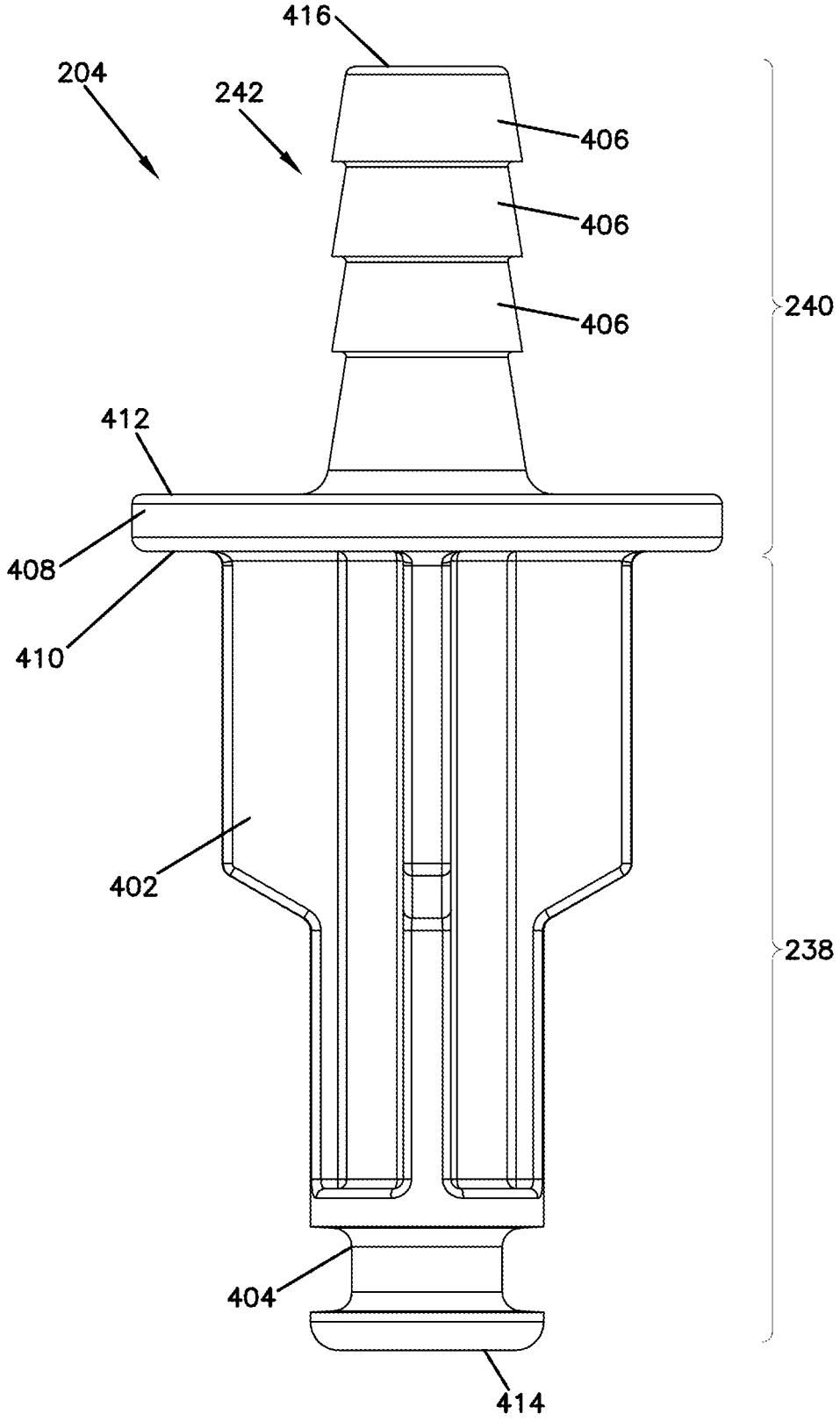
FIG. 4 is a side view of the male coupling of FIG. 2.
Figure 5:
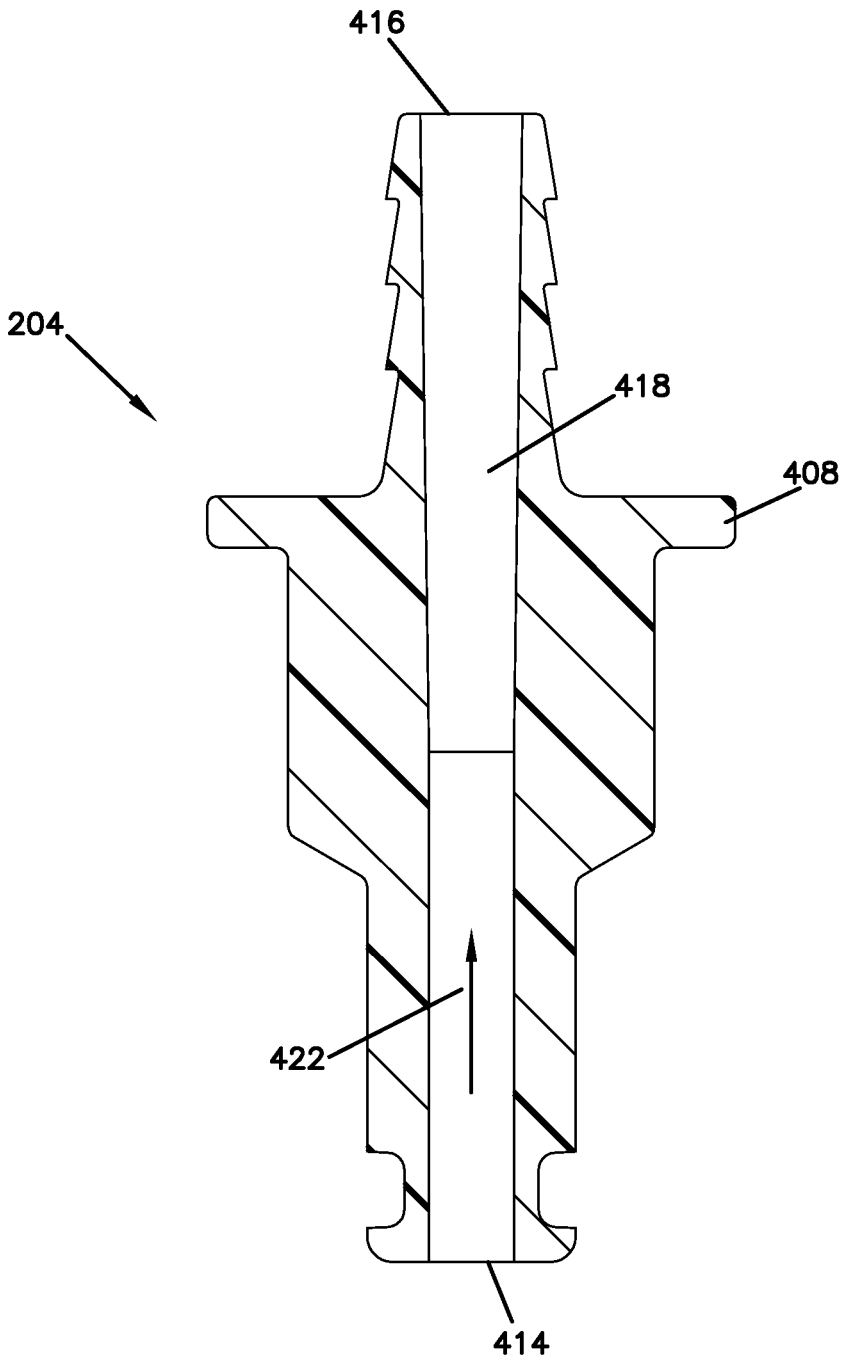
FIG. 5 is cross-sectional view of the male coupling of FIG. 4.
Figure 6:
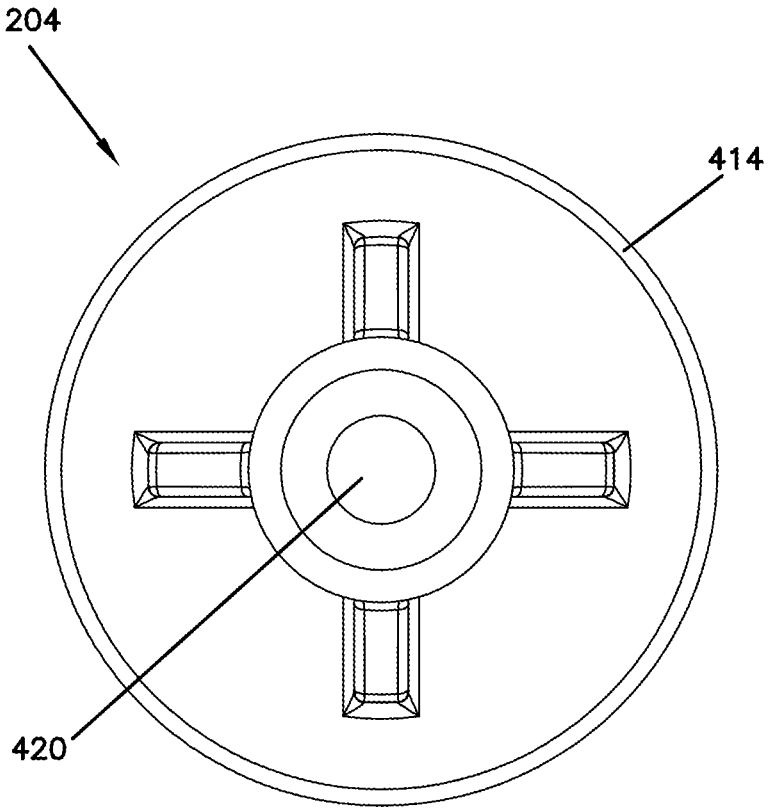
FIG. 6 is a bottom view of the male coupling of FIG. 4.
Figure 7:
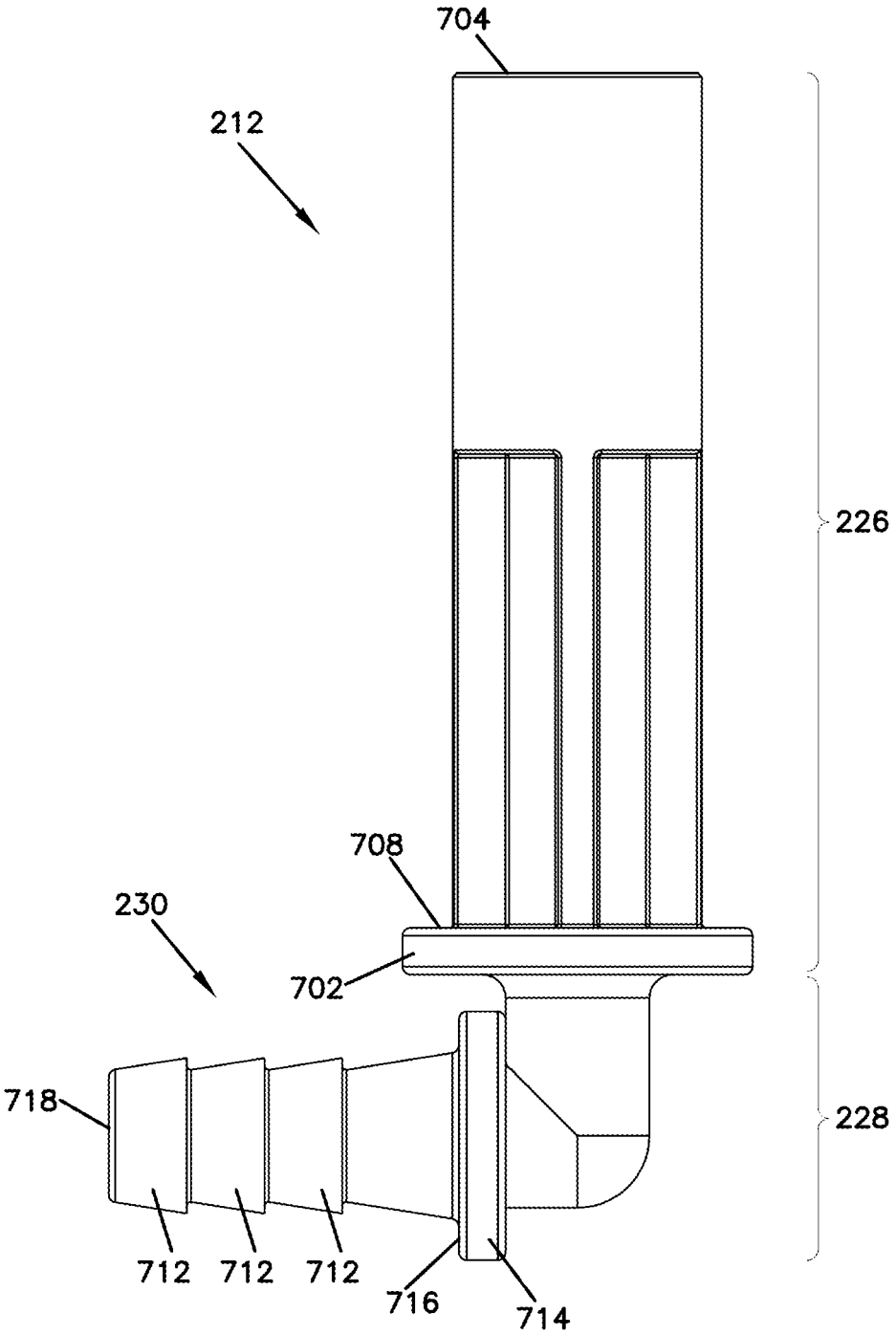
FIG. 7 is a first side view of the female coupling of FIG. 2.
Figure 8:
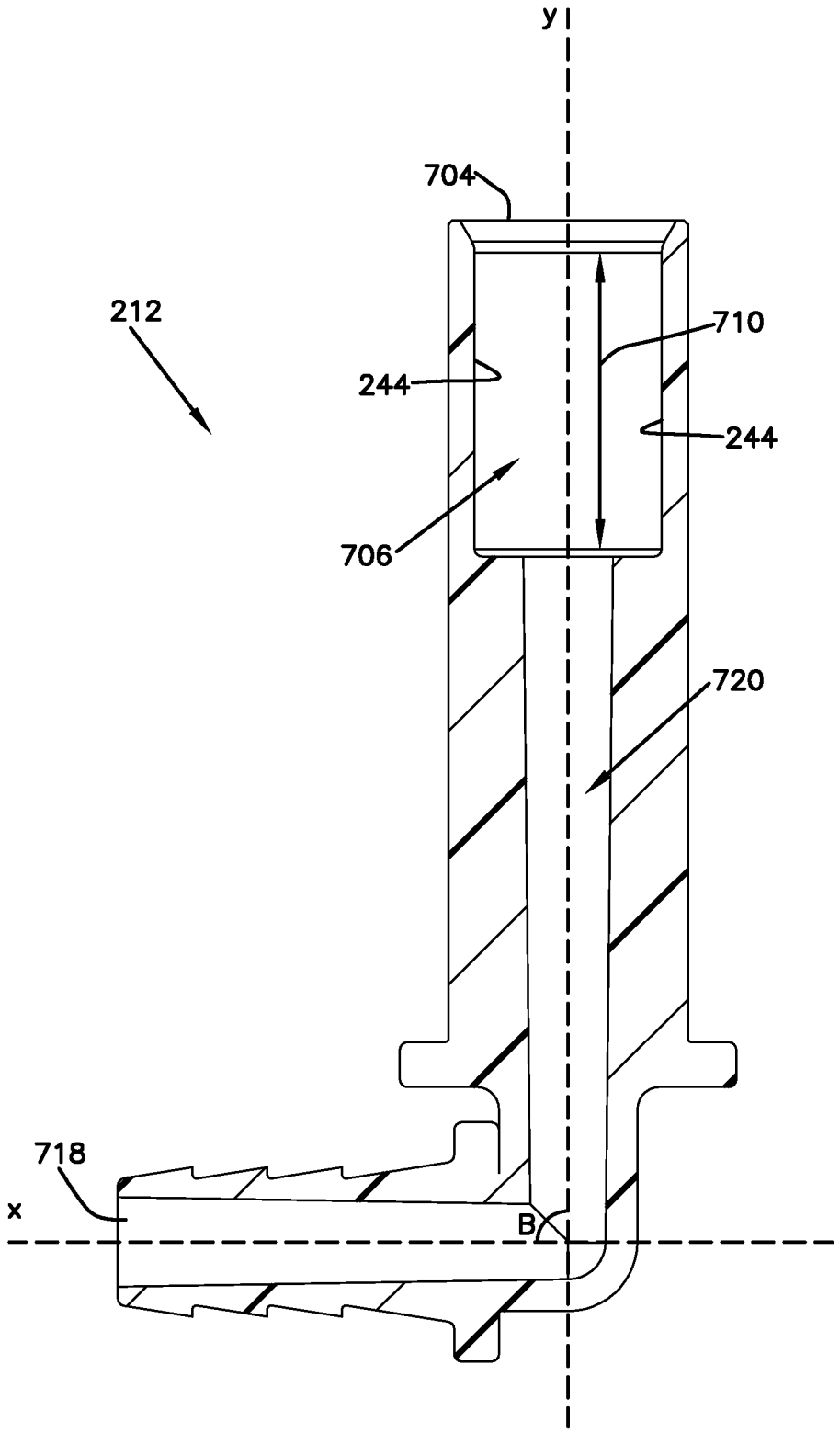
FIG. 8 is a cross-sectional view of the female coupling of FIG. 7.
Figure 9:
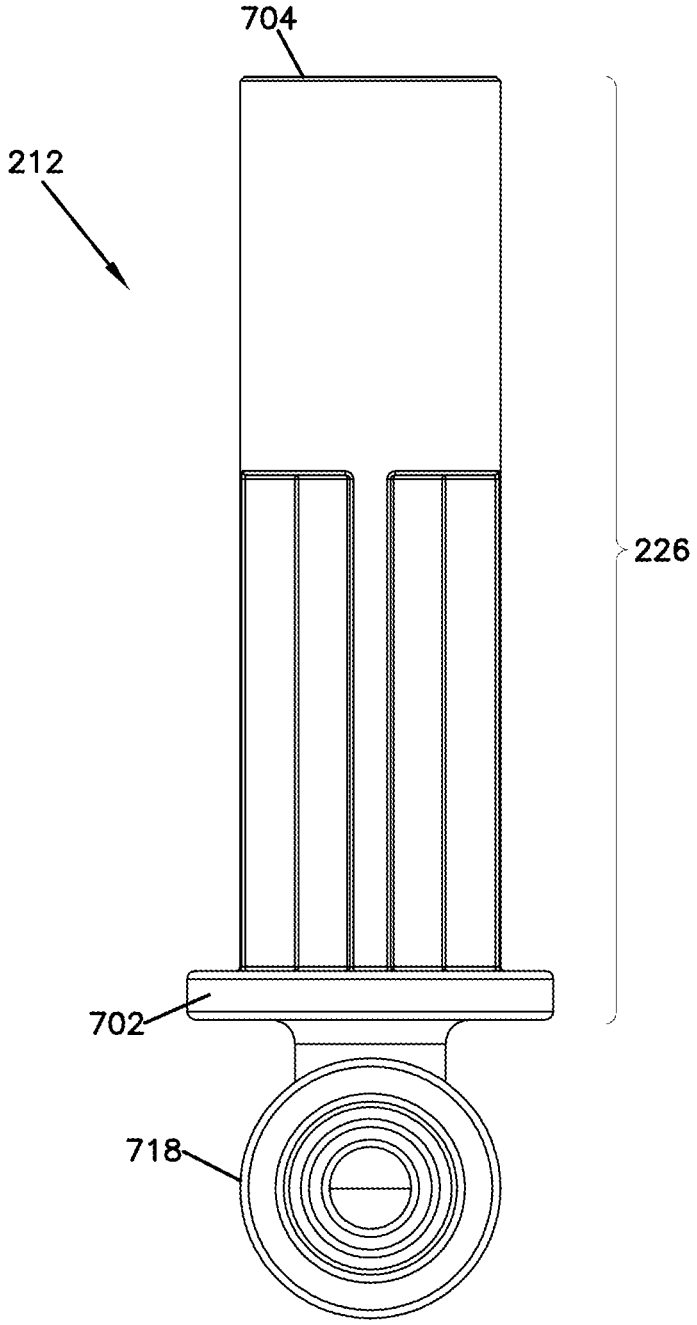
FIG. 9 is a second side view of the female coupling of FIG. 7.
Figure 10:
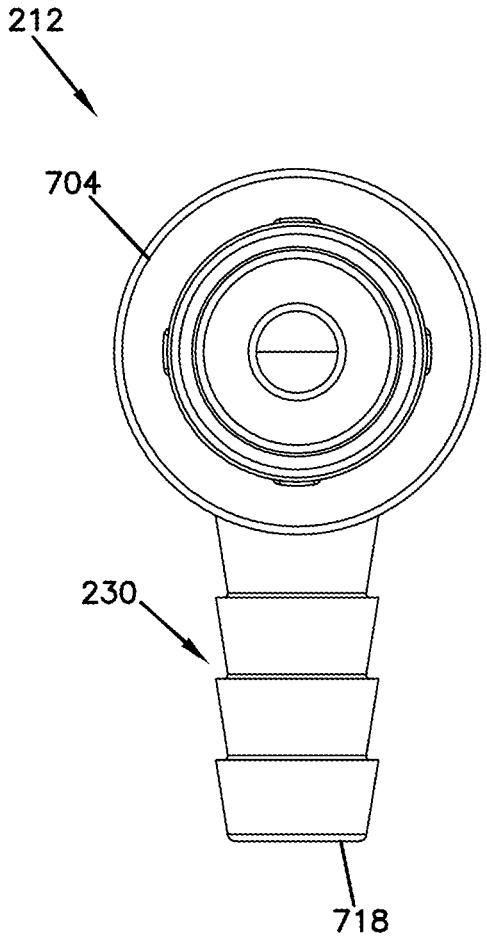
FIG. 10 is a top view of the female coupling of FIG. 2.

Referring now to FIGS. 4-6, the male coupling 204 of the example lower hinge assembly 108 is shown according to the principles of the present disclosure. The example male coupling 204 is shown including the first male coupling section 238 and the second male coupling section 240 including the male coupling termination 242 described above. Other embodiments of the male coupling 204 are possible.

The first male coupling section 238 includes an insert member 402, and a ring member 404. In general, the insert member 402 is defined to have a length to allow for axial displacement of the male coupling 204 upon moving the door 102 between open and closed positions, as described further below. The ring member 404 is configured to receive the sealing ring 206 which radially engages the inner surface 244 of the female coupling 212, also described in further detail below.

The second male coupling section 240 includes a plurality of tapered surfaces 406 formed on the male coupling termination 242 that are configured to radially engage an inner surface of tubing (e.g., second conduit 146) positioned thereon. The tapered surfaces 406 are similar to a hose barb. In other configurations, a compression fitting, tapered thread, instant fitting (John Guest) or other structure can be used to connect the two structures.

The second male coupling section 240 additionally includes a flange member 408. The flange member 408 includes a first flange member side 410 configured to engage the first bushing end 232, and a second flange member side 412 configured to provide a surface for the first retainer 202 to be coupled thereon, as described above.

The male coupling 204 additionally includes a first male coupling end 414 and a second male coupling end 416 connecting a male coupling passage 418 formed within the male coupling 204 to only permit fluid flow through the male coupling passage 418 in a direction 422.

Referring now to FIGS. 7-10, the female coupling 212 of the example lower hinge assembly 108 is shown. The female coupling 212 is shown including the first female coupling section 226 and the second female coupling section 228 including the female coupling termination 230 as described above. Other embodiments of the female coupling 212 are possible. For example, an angle B that defines the angle between first and second female coupling section 226, 228 with respect to axis x-y (see FIG. 8) may be defined as desired.

The first female coupling section 226 includes a first flange 702, an end opening 704, and a lead-in receptacle 706. The first flange 702 includes a first flange side 708 configured to engage the first post end 220 when the first female coupling section 226 is positioned within the post inner passage 224, as described above. The lead-in receptacle 706 is formed within the first female coupling section 226 adjacent to the end opening 704.

The lead-in receptacle 706 is configured to accept a portion of the first male coupling section 238 to facilitate connection of the male coupling 204 to the female coupling 212. When the first male coupling section 238 is positioned within the lead-in receptacle 706, the sealing ring 206 radially engages the inner surface 244 of the lead-in receptacle 706 to form a seal. As described in further detail below, the sealing ring 206 is displaced along a length 710 of the lead-in receptacle 708 when the door 102 is moved between open and closed positions.

The second female coupling section 228 includes a plurality of tapered surfaces 712 formed on the female coupling termination 230 that are configured to radially engage an inner surface of tubing (e.g., first conduit 124) positioned thereon. The second female coupling section 228 additionally includes a second flange 714. The second flange 714 includes a second flange side 716 configured to provide a surface for the second retainer 214 to be coupled thereon, as described above.

The second female coupling section 228 additionally includes a second end opening 718. A female coupling fluid channel 720 is formed through the female coupling 212 from the second end opening 718 to the lead-in receptacle 706.

In example embodiments, one or both of the male coupling 204 and the female coupling 212 can include valves that limit the flow of fluid through the couplings when uncoupled. In example embodiments, the valves can have a tapered seat arrangement, as disclosed in U.S. Pat. No. 5,033,777, which is hereby incorporated by reference. In another example, the valves can be non-spill, such as those described in U.S. Pat. No. 7,547,047, which is also hereby incorporated by reference.

For example, a one-way valve can be incorporated within the lead-in receptacle 706 and/or the second end opening 718 of the female coupling 212. The one-way valves can be configured to only permit fluid flow through the female coupling passage 720 in a direction towards the lead-in receptacle 706. Other configurations are possible.

Figure 11:
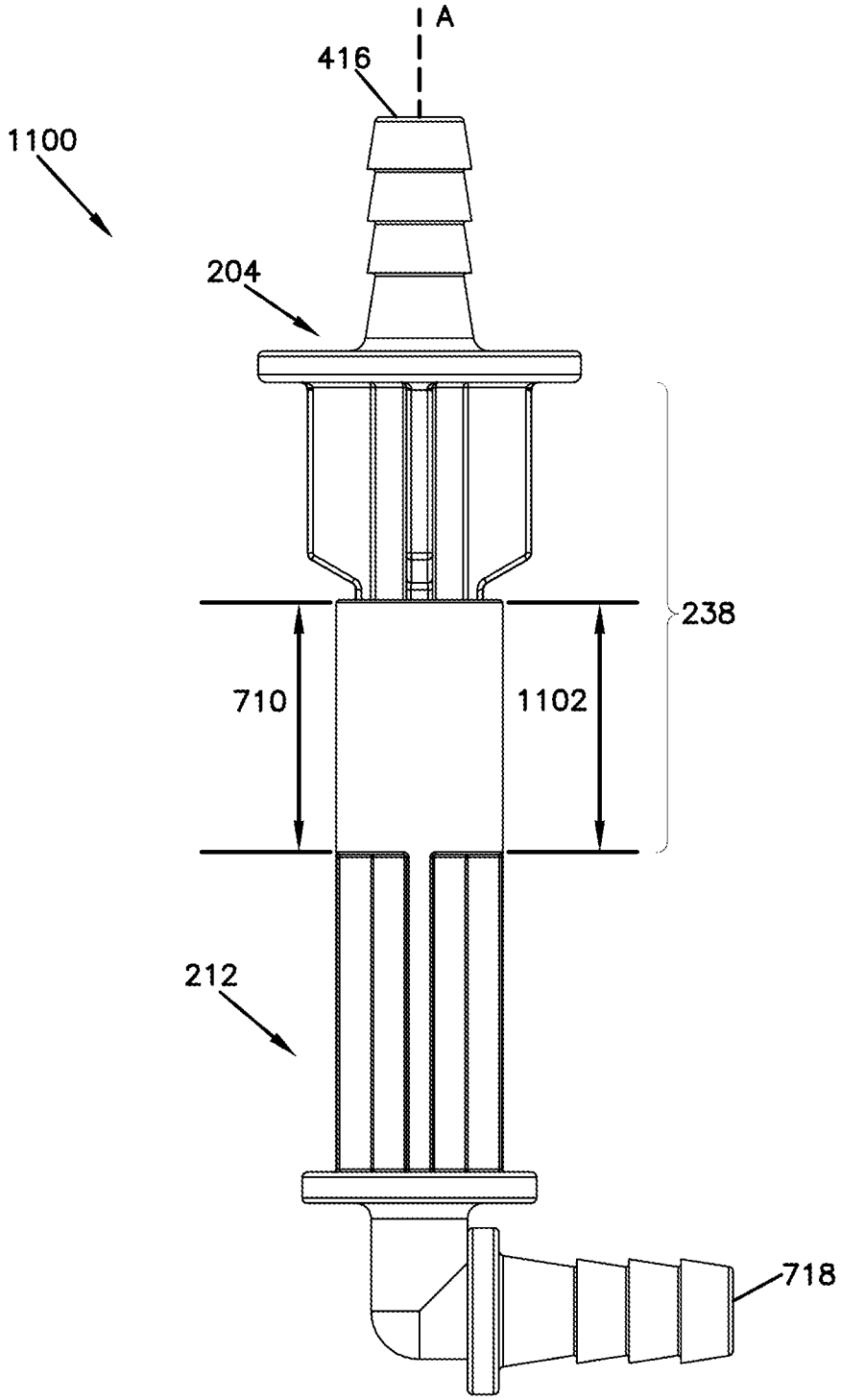
FIG. 11 is a side view of the male coupling and female coupling of FIG. 2 in a first connected position.

Referring now to FIG. 11, when the male coupling 204 is connected to the female coupling 212 and the door 102 of the refrigerator 100 is in a closed position (see FIG. 1) a sealed continuous fluid flow path is formed between the male coupling passage 418 and the female coupling passage 720. Specifically, FIG. 11 shows a first connected position 1100 in which a length 1102 of the insert member 402 of the male coupling 204 corresponding to length 710 (see FIG. 8) is positioned within the lead-in receptacle 706 of the female coupling 212. In example embodiments, the sealing ring 206 radially engages the inner surface 244 of the lead-in receptacle 706 to form a seal. In this manner, a sealed continuous fluid flow path is formed for fluid transfer from the second end opening 718 of the female coupling 212 to the second male coupling end 416 of the male coupling 204.

Figure 12:
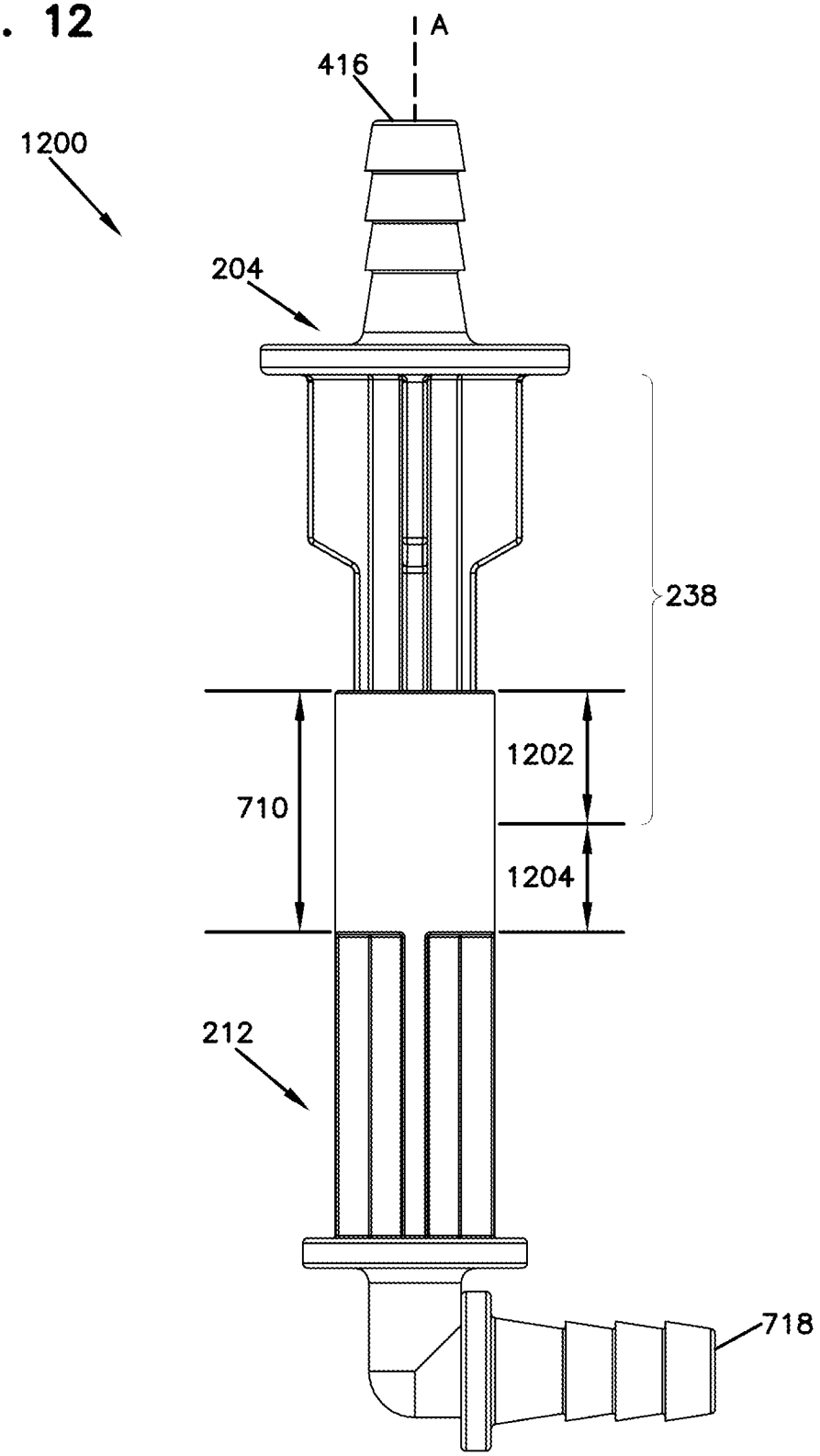
FIG. 12 is a side view of the male coupling and female coupling of FIG. 2 in a second connected position.

Referring now to FIG. 12, when the male coupling 204 is connected to the female coupling 212 and the door 102 of the refrigerator 100 is in a fully open position, the male coupling 204 is rotated and displaced axially along axis A with respect to the female coupling 212, as the male coupling 204 is affixed to the door 102 and the female coupling 212 is affixed to the refrigerator 100, as described above. Specifically, FIG. 12 shows a second connected position 1200 in which a length 1202 of the insert member 402 of the male coupling 204 is positioned within the lead-in receptacle 706 of the female coupling 212.

In the example shown, the sealing ring 206 is displaced a distance 1204 when the door 204 is moved from the closed position (see FIGS. 1 and 11) to a fully open position. However, the seal formed by the sealing ring 206 that radially engages the inner surface 244 of the lead-in receptacle 706 is maintained. In this manner, the sealed continuous fluid flow path is maintained for fluid transfer from the second end opening 718 of the female coupling 212 to the second male coupling end 416 of the male coupling 204. The distance 1204 is generally reduced when the door 102 is positioned somewhere between closed and fully open positions.

In general, rotation and displacement of the male coupling 204 over distance 1204 is resultant from a corresponding displacement of a self-closing cam mechanism that uses gravity to promote movement of the door 102 from an open to a closed position without user actuation. This results in a self-closing door, which naturally rotates to the closed position based on the weight of the door 102.

Figure 13:
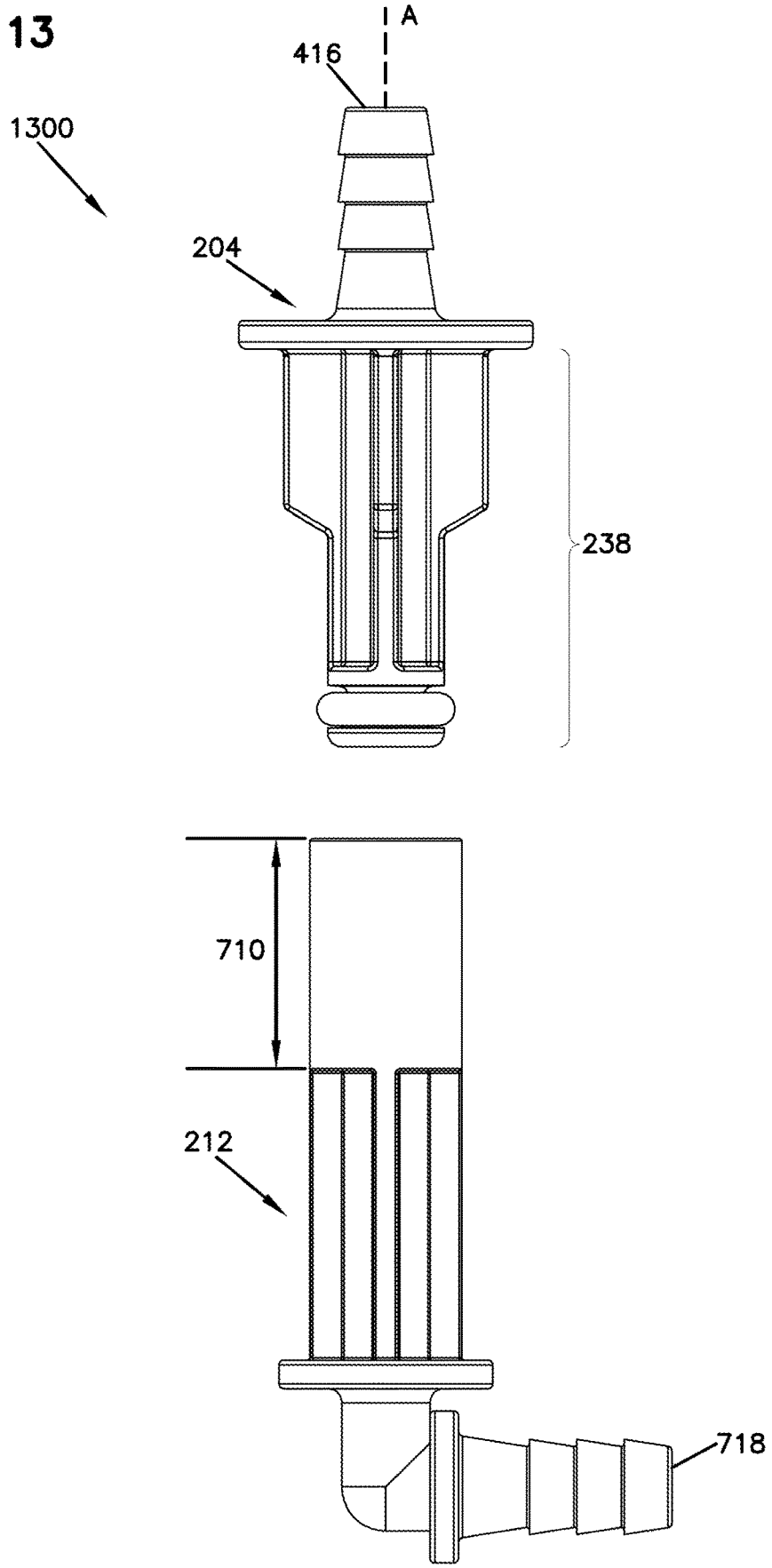
FIG. 13 is a side view of the male coupling and female coupling of FIG. 2 in a disconnected position.

Referring now to FIG. 13, a disconnected position 1300 is shown in which the insert member 402 of the male coupling 204 is fully removed from the lead-in receptacle 706 of the female coupling 212. Disconnection of the male coupling 204 from the female coupling 212 corresponds to removal of the door 102 from the refrigerator 100, as the male coupling 204 is affixed to the door 102 and the female coupling 212 is affixed to the refrigerator 100, as described above. Upon disconnection, the sealed continuous fluid flow path for fluid transfer from the second end opening 718 of the female coupling 212 to the second male coupling end 416 of the male coupling 204 is broken, as described above.

In example embodiments, the male coupling 204 and the female coupling 212 are made of a material such as a thermoplastic that provides for good structural integrity and surface finish. In one example, a thermoplastic such as acetal is used. Examples of other materials that can be used include, but are not limited to, polyvinyl chloride, polypropylene, nylon, polycarbonate, polyethylene, polyester, and Acrylonitrile-Butadiene-Styrene (ABS). Other materials can be used.

In the example shown, the male coupling 204 and the female coupling 212 are made using an injection molding process. In such an example injection molding process, a resin is heated beyond the resin's melting point and injected into a steel or aluminum mold to form components of the assembly. Other potential methods of manufacture include, but are not limited to, machining the complete assembly, or machining (or molding) components of the assembly and bonding them together. Other methods of manufacture can be used, such as die casting or metal injection molding.

Other configurations for the hinge coupling assembly described herein can be used. For example, in other embodiments, a female coupling can be incorporated into the hinge, and a male coupling can be incorporated into the door. In other examples, the couplings can be different types of couplings. For example, instead of fluid couplings as described in the embodiments herein, the couplings can be electrical couplings that make electrical connections when coupled.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for connecting a fluid coupling system between a door and a door frame, the method comprising:
   incorporating a first coupling of the fluid coupling system within a bushing of a first hinge section;
   affixing the first hinge section having the first coupling within the bushing to the door;
   incorporating a second coupling of the fluid coupling system within a second hinge section separate from the first hinge section and coupled to the door frame; and
   attaching the door to the door frame to form a sealed continuous fluid passage through the first and second couplings, the sealed continuous fluid passage being maintained upon rotational displacement of the first coupling with respect to the second coupling upon opening and closing of the door relative to the door frame.

2. The method of claim 1, wherein the door and the door frame are components of a refrigerator, the method further comprising:
   coupling the second coupling to a water conduit; and
   coupling the first coupling to a distributer positioned in the door of the refrigerator.

3. The method of claim 1, further comprising allowing the door to pivot about the first hinge section and the second hinge section upon opening and closing the door relative to the door frame.

4. The method of claim 3, further comprising allowing the first coupling to rotate within the second coupling as the door is opened and closed relative to the door frame.

5. The method of claim 1, further comprising allowing the first coupling to rotate within the second coupling as the door is opened and closed relative to the door frame.

6. The method of claim 1, further comprising removing the door from the door frame to decouple the first coupling from the second coupling.

7. The method of claim 1, wherein the sealed continuous fluid passage is maintained upon axial displacement of the first coupling with respect to the second coupling upon opening and closing of the door relative to the door frame.

8. The method of claim 1, wherein the first coupling is a male coupling and the second coupling is a female coupling.

* * * * *